US008286832B2

(12) United States Patent
Keller

(10) Patent No.: US 8,286,832 B2
(45) Date of Patent: Oct. 16, 2012

(54) DISPENSING DEVICE FOR SINGLE USE

(75) Inventor: Wilhelm A. Keller, Merlischachen (CH)

(73) Assignee: Sulzer Mixpac AG, Rotkreuz (CH)

( * ) Notice: Subject to any disclaimer, the term of this patent is extended or adjusted under 35 U.S.C. 154(b) by 1095 days.

(21) Appl. No.: 12/086,729

(22) PCT Filed: Dec. 7, 2006

(86) PCT No.: PCT/CH2006/000687

§ 371 (c)(1),
(2), (4) Date: Jun. 18, 2008

(87) PCT Pub. No.: WO2007/073607

PCT Pub. Date: Jul. 5, 2007

(65) Prior Publication Data

US 2008/0314929 A1 Dec. 25, 2008

(30) Foreign Application Priority Data

Dec. 29, 2005 (CH) ..... 2090/05

(51) Int. Cl.
*B67D 7/78* (2010.01)

(52) U.S. Cl. ..... 222/145.6; 222/554; 222/570

(58) Field of Classification Search ..... 222/567, 222/554, 563, 566, 570, 145.6
See application file for complete search history.

(56) References Cited

U.S. PATENT DOCUMENTS

| | | | | |
|---|---|---|---|---|
| 3,506,157 | A * | 4/1970 | Dukess | 222/94 |
| 5,413,253 | A | 5/1995 | Simmen | |
| 5,918,772 | A | 7/1999 | Keller et al. | |
| 6,398,761 | B1 * | 6/2002 | Bills et al. | 604/191 |
| 7,556,618 | B2 * | 7/2009 | Sogaro | 604/191 |

FOREIGN PATENT DOCUMENTS

| | | | |
|---|---|---|---|
| EP | 1 440 737 | A1 | 7/2004 |
| WO | WO 2005/021394 | A2 | 3/2005 |
| WO | WO 2006/005213 | A1 | 1/2006 |

* cited by examiner

*Primary Examiner* — Kevin P Shaver
*Assistant Examiner* — Melvin Cartagena
(74) *Attorney, Agent, or Firm* — Kilpatrick Townsend & Stockton LLP

(57) ABSTRACT

The dispensing device for single use includes a multicomponent cartridge (1), a mixer (8) having a mixer housing (9), as well as closure means for closing the outlets (4, 5) of the multicomponent cartridge. These closure means are connected to the mixer housing and comprise a respective closure stopper (13, 14) for each outlet that is insertable in an outlet (4, 5) of the multicomponent cartridge and is deformable such that upon rotation of the mixer housing relative to the cartridge, the closure stoppers (13, 14) are removed from the outlets (4, 5) of the multicomponent cartridge.

20 Claims, 3 Drawing Sheets

DISPENSING DEVICE FOR SINGLE USE

CROSS-REFERENCE TO RELATED APPLICATIONS

This application is a National Stage of International Application No. PCT/CH2006/000687, filed Dec. 7, 2006, and which claims the benefit of Swiss Patent Application No. 2090/05, filed Dec. 29, 2005, the disclosures of both applications being incorporated herein by reference.

BACKGROUND OF THE INVENTION

The present invention relates to a dispensing device for single use that includes a multicomponent cartridge or syringe, a mixer having a mixer housing, as well as closure means for closing and opening the outlets of the multicomponent cartridge or syringe.

Currently, dispensing devices are generally reused; i.e. the content of the multicomponent cartridge or syringe is sufficient for multiple applications while the static mixer can only be used for a single application and is then replaced. In applications of multicomponent cartridges or syringes in medicine, however, the tendency is toward single use. The advantage is that a possible contamination of the patient is prevented since a single application, i.e. a treatment for a single patient only, can thus be ensured.

Dispensing devices of the prior art, for example WO 2006/005213 A, WO 2005/021394 A, U.S. Pat. No. 5,918,772 A to the same applicant, have a cartridge with a closure that has to be removed prior to the application in order to be able to attach the mixer. Other dispensing devices comprise more or less complicated valve arrangements in order to prevent multiple use.

SUMMARY OF THE INVENTION

For single use in the medical field, such dispensing devices of the prior art are too demanding both with respect to handling as with regard to manufacture, and it is consequentially an object of the present invention to provide a dispensing device that is both economical to manufacture and simple and quick and above all safe to handle.

The invention will be explained in more detail hereinafter with reference to schematic drawings of an exemplary embodiment. The drawings essentially only show the interface between the mixer and the multicomponent cartridge or syringe, FIGS. 1-3 and 7 illustrating the dispensing device in the closed position and FIGS. 4-6 and 8 illustrating the dispensing device in the open position. The accessory may have one inlet or two separate inlets, but the number of closure stoppers is equal to the number of outlets on the cartridge or syringe.

DESCRIPTION OF THE PREFERRED EMBODIMENTS

Figure 1:
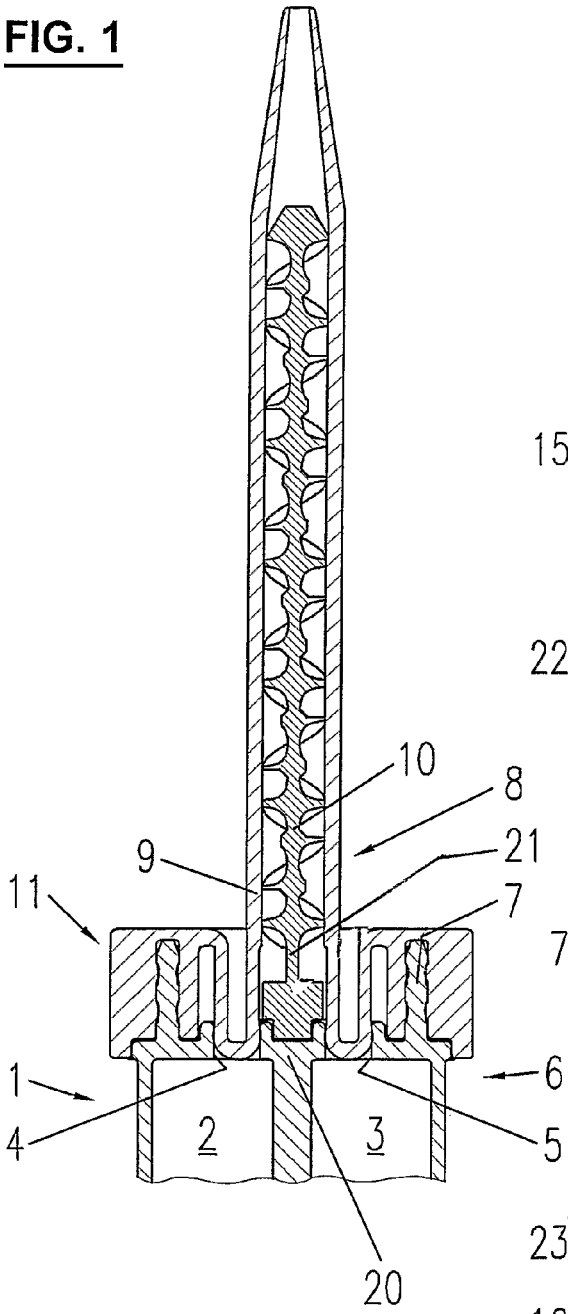
FIG. 1 shows a sectional view of a mixer and of the coupling region with a double cartridge or syringe.
Figure 2:
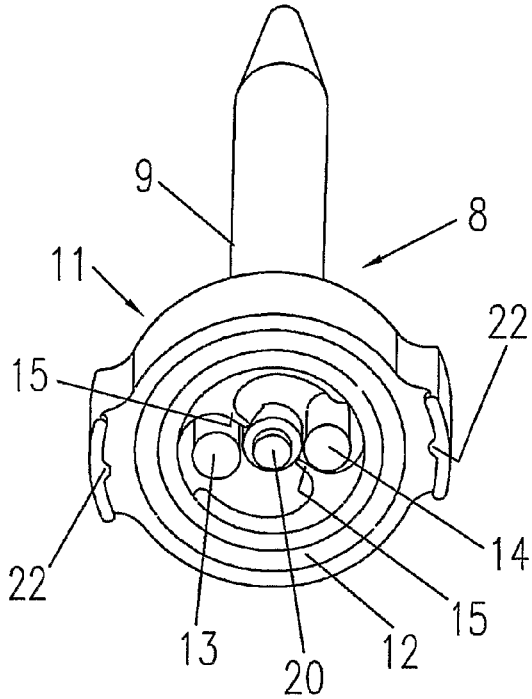
FIG. 2 shows a perspective view of the mixer inlet section.

FIG. 1 illustrates the outlet section of double cartridge 1 with the two storage containers 2 and 3, the two outlet nozzles 4 and 5 as well as outlet flange 6 provided with a circumferential, grooved snap bead 7.

Mixer 8 essentially consists of a mixer housing 9 and a mixing element 10 arranged therein. The inlet section of mixer 8 has an inlet flange 11 and an internal groove 12 receiving snap bead 7 and cooperating therewith.

According to the invention, mixer housing 9 is provided with closure stoppers 13 and 14, which are generally injection-molded integrally with the mixer housing and are insertable in outlets 2 and 3. Between closure stoppers 13 and 14, a curved separating wall 15 is arranged. Mixing element 10, seen from the inlet, has an inlet side end 20 that is followed by a separating wall 21. The purpose of both mixer housing separating wall 15 and mixing element separating wall 21 is to keep the components separated up to the first mixing segment.

Figure 3:
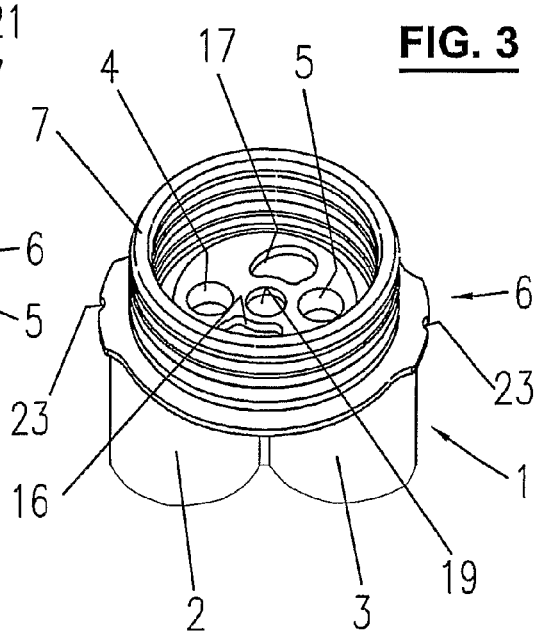
FIG. 3 shows a perspective view of the outlet section of the double cartridge or syringe.
Figure 8:
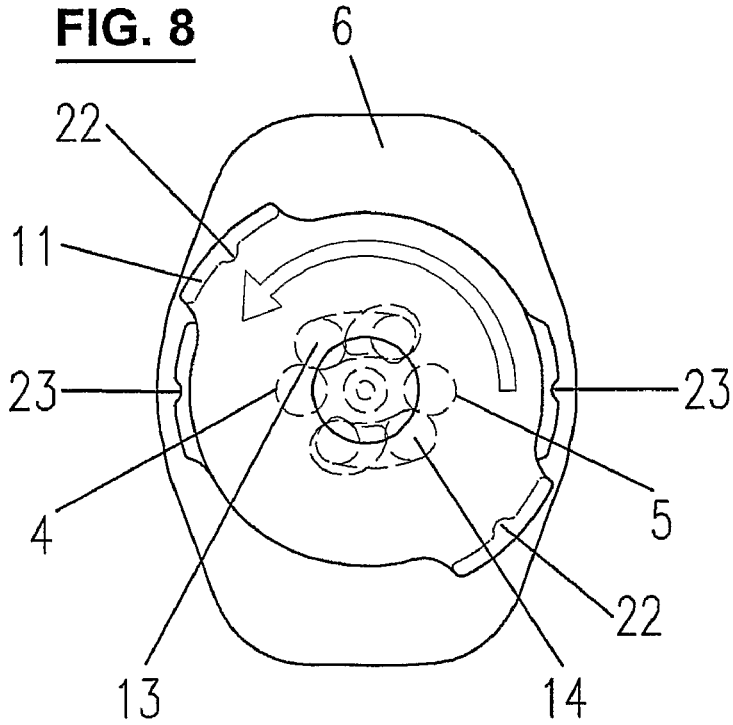
FIG. 8 shows a top view of the cartridge and of the mixer of FIG. 4 having been rotated in the direction of the arrow.

In FIG. 3, two indentations 16 and 17 are depicted in outlet flange 6 which serve as an anti-reversal safety and are offset about 40°-120° with respect to the outlets 4 and 5. These indentations (see in particular FIG. 8) are intended to receive the ends 18 of closure stoppers 13, 14 after a rotation of the mixer housing by about 90°-180° and to prevent that the mixer housing may be turned back. For this purpose, the ends 18 of the closure stoppers may be entirely or only partly rounded or may have another shape that is suitable for providing an anti-reversal action in indentations 16 and 17. In this manner, the outlets remain free and the material can be dispensed. Furthermore, a depression 19 intended to receive end 20 on the outlet side of the mixing element is arranged in outlet flange 6.

Figure 4:
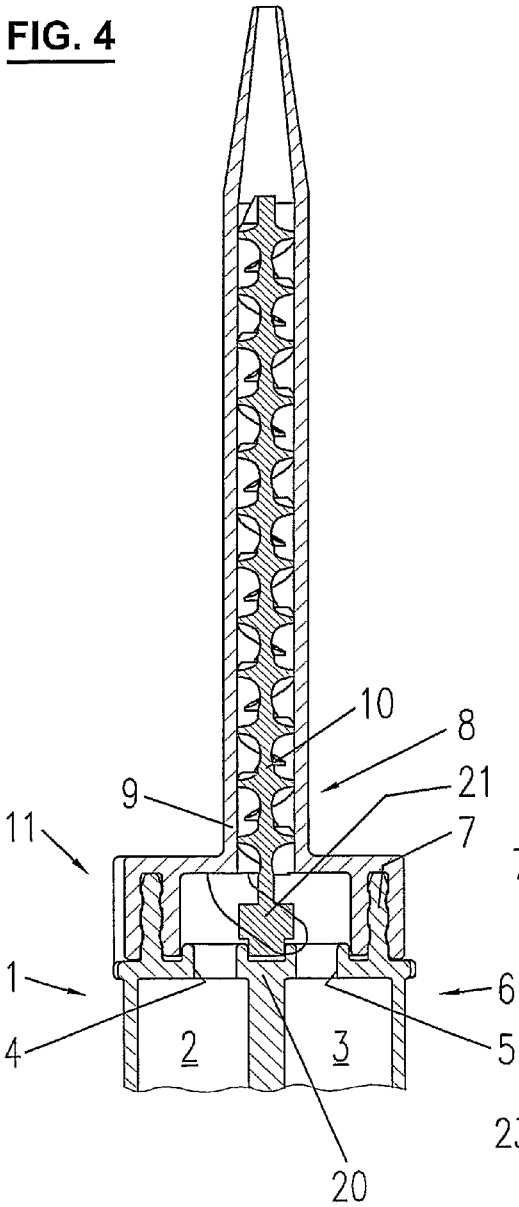
FIGS. 4-6 show the same elements as in FIGS. 1-3 in a position of the mixer housing having been rotated in the direction of the arrow (see FIG. 8)
Figure 5:
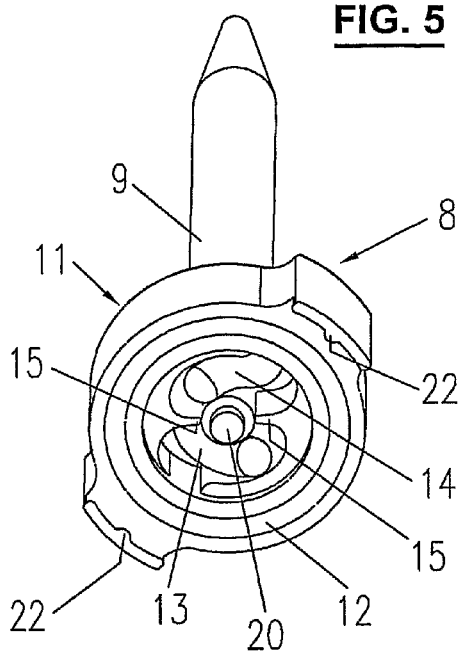
Figure 6:
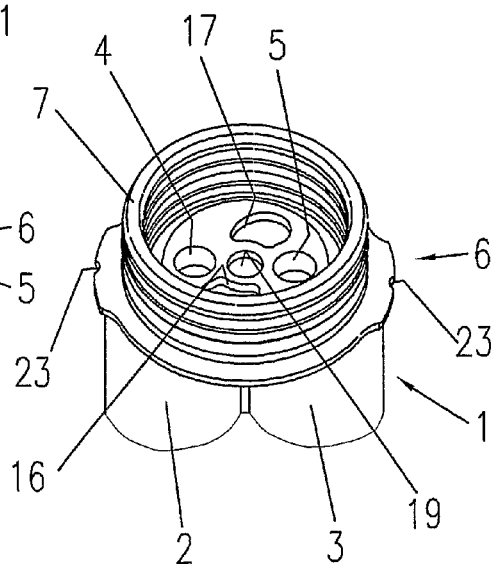
Figure 7:
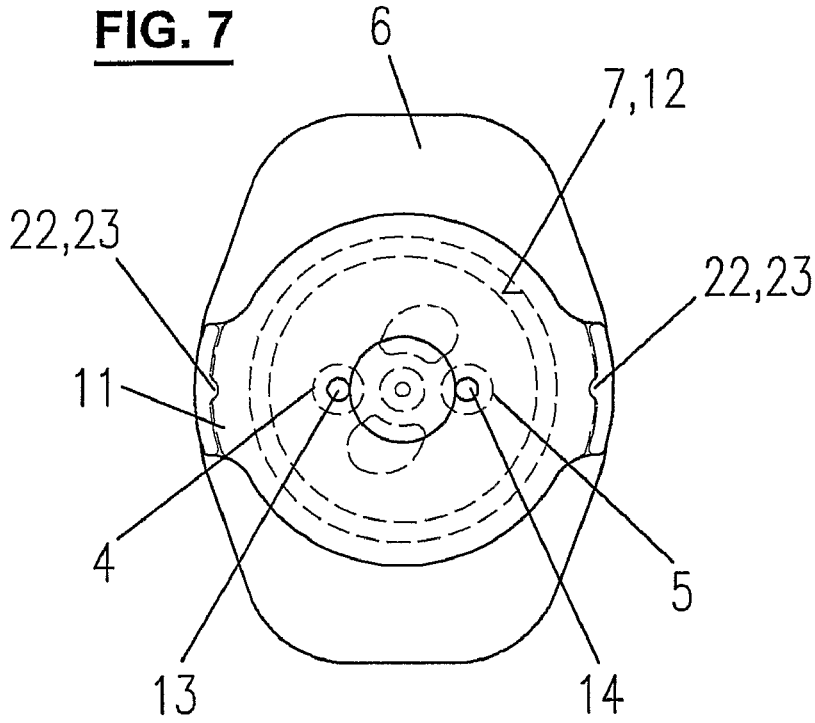
FIG. 7 shows a top view of the cartridge and of the mixer of FIG. 1.

As appears especially in FIG. 5, the closure stoppers 13 and 14 are relatively strongly bent in the open position and it is therefore evident that the latter and, if the mixer housing is integrally formed with the closure stoppers, also the mixer housing has to be produced from a material that is suitable therefor. Moreover, the closure stoppers are preferably hollow, as is clearly visible in FIGS. 1 and 4.

As already mentioned, a position of the mixer housing when rotated by about 135° with respect to FIGS. 1-3 and 7 is illustrated in FIGS. 4-6 and 8 where the closure stoppers 13 and 14 have slipped out of the outlets 4, 5 and are engaged in the indentations 16, 17 in the outlet flange 6 of the cartridge. As mentioned, the rotation of the mixer housing with respect to the cartridge may amount to about 90°-180°.

In FIG. 1 or 4 it is further visible that the mixer is pushed onto the cartridge and engaged at the cartridge by means of internal groove 12 at the mixer and snap bead 7 at the cartridge such that the mixer housing may still be rotated with respect to the cartridge but no longer withdrawn therefrom.

At the outlet side end, snap means in the form of noses 22 and corresponding notches 23 are suitably provided inside inlet flange 11 of the mixer and on the cartridge outlet flange such that the mixer housing is always in a defined position with respect to the cartridge and an involuntary rotation is avoided especially in the end positions. Consequently, further notches for the open position may also be provided.

A tear-off opening seal as it is known per se e.g. in medical containers may suitably be provided.

The further design of the cartridge or syringe is not depicted here as the most diverse embodiments enter into consideration for the latter and are not inventively essential. Thus, the cartridge or syringe may be directly operated manually or by means of a dispensing appliance. The same applies to the mixer, which may have an outlet or an attachment of any kind.

With respect to the exemplary embodiment, it has been said that the closure stoppers are integrally formed with the mixer housing or attachment. Although this is currently considered to be the best solution, it is also possible within the scope of the invention to provide separate closure stoppers of another material than the mixer housing or accessory, which are attachable to the mixer housing or accessory.

The invention also encompasses cartridges or syringes having more than two components, e.g. three, in which case more than two closure stoppers on the mixer housing or accessory will correspondingly result.

The invention claimed is:

1. A dispensing device for single use, including a multicomponent cartridge or syringe comprising outlets, a mixer having a mixer housing and a mixing element, or an accessory, as well as closure means for closing the outlets of the multicomponent cartridge or syringe, whereby the closure means, which are connected to the mixer housing or accessory, comprise a closure stopper for each outlet that is insertable in the outlet of the multicomponent cartridge or syringe and is deformable such that by rotating the mixer housing or accessory relative to the multicomponent cartridge or syringe, and thus rotating the closure stoppers relative to the multicomponent cartridge or syringe, the closure stoppers bend relative to the multicomponent cartridge or syringe to thereby be removed from the outlets of the multicomponent cartridge or syringe.

2. The dispensing device according to claim 1, characterized in that the multicomponent cartridge or syringe has an outlet section, and the outlet section has an anti-reversal safety means in order to prevent the deformed closure stoppers from being turned back.

3. The dispensing device according to claim 1, characterized in that the mixer housing or accessory further defines inlets and a separating wall between the inlets.

4. The dispensing device according to claim 1, characterized in that ends of the closure stoppers are entirely or partly rounded.

5. The dispensing device according to claim 1, characterized in that the closure stoppers are hollow.

6. The dispensing device according to claim 1, characterized in that the closure stoppers are made from a material that is different from that of the mixer housing or accessory and are fastened thereto.

7. The dispensing device according to claim 1, characterized in that the rotatable mixer housing or the accessory comprises snap-in means cooperating with corresponding snap-in means on an outlet flange of the cartridge or syringe.

8. The dispensing device according to claim 1, wherein rotating the mixer housing or accessory relative to the multicomponent cartridge or syringe comprises rotating the mixer housing or accessory from about 90° to about 180°.

9. The dispensing device according to claim 1, wherein the multicomponent cartridge or syringe further comprises two storage containers, each associated with one of the outlets, and an outlet flange comprising a grooved snap bead.

10. The dispensing device according to claim 1, wherein the closure stoppers are injection molded integrally with the mixer housing.

11. The dispensing device according to claim 1, wherein the mixer housing further comprises a separating wall between the closure stoppers.

12. The dispensing device according to claim 1, wherein the mixing element comprises a separating wall near an inlet side of the mixing element.

13. The dispensing device according to claim 1, wherein the mixer comprises a groove and the multicomponent cartridge or syringe comprises a snap bead configured for engagement with the groove.

14. A dispensing apparatus, comprising:

a cartridge comprising a plurality of chambers, wherein each chamber defines an outlet; and a mixer, comprising:

a mixer housing;

inlets configured for connection to the outlets of the chambers;

an outlet;

a mixing element disposed within the mixer housing between the inlets and the mixer outlet; and a plurality of stoppers, wherein each stopper is insertable into one of the cartridge outlets to close the outlet, and is deformable, such that rotation of the mixer housing relative to the cartridge removes the stoppers from the cartridge outlets.

15. The apparatus of claim 14, wherein the cartridge further comprises an anti-reversal safety element configured to block the stoppers to prevent the mixer from being turned back opposite the direction of rotation.

16. The apparatus of claim 14, wherein the mixer further comprises at least one separating wall between the inlets.

17. The apparatus of claim 14, wherein the stoppers are rounded.

18. The apparatus of claim 14, wherein the stoppers are hollow.

19. The apparatus of claim 14, wherein the stoppers are made from a material that is different from that of the mixer housing and are fastened thereto.

20. The apparatus of claim 14, wherein the mixer housing and the cartridge are further configured to be snapped together.

* * * * *